US007891056B2

(12) United States Patent
McAfee

(10) Patent No.: US 7,891,056 B2
(45) Date of Patent: Feb. 22, 2011

(54) LOCKING DOOR HINGE

(76) Inventor: John J. McAfee, 2862 La Cresenta Ave., Merced, CA (US) 95348

( * ) Notice: Subject to any disclaimer, the term of this patent is extended or adjusted under 35 U.S.C. 154(b) by 499 days.

(21) Appl. No.: 11/982,572

(22) Filed: Nov. 2, 2007

(65) Prior Publication Data

US 2009/0133223 A1 May 28, 2009

Related U.S. Application Data

(60) Provisional application No. 60/856,806, filed on Nov. 6, 2006.

(51) Int. Cl.
*E05D 11/06* (2006.01)

(52) U.S. Cl. ..... 16/374; 16/353; 16/331; 16/334

(58) Field of Classification Search ..... 16/374, 16/376, 377, 324, 326, 327, 328, 331, 332, 16/380, 381
See application file for complete search history.

(56) References Cited

U.S. PATENT DOCUMENTS

| | | | | | |
|---|---|---|---|---|---|
| 853,507 | A * | 5/1907 | Fielding | 16/329 |
| 1,092,926 | A | 4/1914 | Madsen | |
| 1,903,251 | A * | 3/1933 | Ahrens | 16/375 |
| 2,462,268 | A * | 2/1949 | Kahi | 70/1 |
| 2,592,230 | A * | 4/1952 | Allen | 16/223 |
| 2,799,888 | A * | 7/1957 | White | 16/375 |
| 3,048,883 | A * | 8/1962 | Rizzuto | 16/353 |
| 3,263,269 | A | 8/1966 | McGahee | |
| 3,579,712 | A * | 5/1971 | Smith | 16/329 |
| 3,769,928 | A * | 11/1973 | Kahl | 114/221 R |
| 3,805,325 | A | 4/1974 | Lee | |
| 4,125,288 | A * | 11/1978 | Hunter | 297/301.3 |
| 4,991,259 | A * | 2/1991 | Finkelstein et al. | 16/312 |
| 6,151,757 | A | 11/2000 | Beals, Jr. et al. | |
| 6,591,453 | B2 * | 7/2003 | Jenks | 16/353 |
| 7,100,243 | B1 * | 9/2006 | Platzke | 16/326 |
| 7,296,832 | B1 | 11/2007 | Campbell | |
| 2006/0218749 | A1 * | 10/2006 | Brown et al. | 16/332 |

* cited by examiner

*Primary Examiner*—Chuck Y. Mah
(74) *Attorney, Agent, or Firm*—Richard A. Ryan

(57) ABSTRACT

A locking door hinge for securing a door in a fixed position, such as closed, partially open or fully open. In one embodiment, the locking door hinge is configured similar to a butt hinge having a pair of generally rectangular leaves with barrels at the proximal end thereof and a pivot pin that passes through the barrels to pivotally connect the leaves together. To prevent movement of the door, the locking door hinge has a locking pin that is received in a locking socket which is disposed in at least the top two adjacent barrels. In a preferred embodiment, the locking socket is disposed in each of the barrels such that the locking pin extends from the first end to the second end of the hinge. If desired, a plurality of locking sockets can be provided to allow the user to fix the extent to which the door is open.

15 Claims, 2 Drawing Sheets

LOCKING DOOR HINGE

CROSS-REFERENCE TO RELATED APPLICATIONS

This application claims the benefit of U.S. Provisional Patent Application No. 60/856,806 filed Nov. 6, 2006.

BACKGROUND OF THE INVENTION

A. Field of the Invention

The field of the present invention relates generally to door hinges utilized to pivotally attach a door to a framework or other structure. More particularly, the present invention relates to door hinges that are lockable to prevent the door from swinging open. Even more particularly, the present invention relates to such locking door hinges that utilize a locking pin to prevent the pivoting components of the hinge from rotating relative to each other to lock the door in a closed, partially open or open position.

B. Background

Door hinges are commonly utilized with interior and exterior doors to pivotally attach the door to the door framework or jamb to allow persons to swing the door between the open or closed positions. Although a variety of different types of hinges are utilized with doors, one common type of door hinge is the butt hinge. The butt hinge generally comprises a pair of generally rectangular leaves that are joined together with a metal rod or pin that passes through engaged barrels on the proximal end of the leaves. One leaf attaches to the door and the other attaches to the framework, typically utilizing screws placed through apertures in both of the leaves. When the door is closed the leaves meet and only the barrels and pin are visible, which is one of the popular features of butt hinges.

Numerous mechanisms are available for locking a door in its closed position or a partially closed position. One common type of apparatus for locking a door comprises a locking mechanism disposed in the door handle or knob that engages a portion of the handle/knob to prevent a person from turning or rotating the handle/knob and opening the door. Another common door locking apparatus is commonly referred to as a deadbolt lock, which typically comprises a locking mechanism on the door, which may be separate and spaced apart from the door handle/knob, that is configured to extend an relatively strong elongated member into a cavity in the door framework in a manner that prevents the door from opening. Other common types of door locking apparatuses include various styles of barrel or pin locks, chain locks and latches. Generally, the primary purpose of these door locks is to prevent unauthorized entry into a building or room by preventing a person from opening or at least fully opening the door.

Another common use for door locks is to keep a person, such as a young child, in a building or room by preventing them from fully opening the door. One problem with many of the available door lock systems is that they are often positioned relatively low on the door or framework such that a child can reach the door lock, unlock the locking mechanism and open the door. Doing so can allow the child to leave the building/room without permission or allow an unauthorized person, such as a stranger, to enter the building/room, both of which can have dire consequences for the child and/or others. Some of the existing door locks, such as the chain and latch types of locks, are configured such that they can be placed relatively high on the door or framework so a small child cannot reach the lock and unlock it. Placing the lock high on the door, however, makes it very difficult if not impossible for a handicapped (i.e., wheelchair bound) person to reach the lock to lock or unlock the door. Unless two locks are purchased and installed on the door, with one placed high and the other placed low, the user must decide ahead of time if he or she is primarily concerned with preventing a child from reaching the lock or allowing a handicapped person to reach the lock.

Another type of door locking apparatus is the locking door hinge. In general, such apparatuses work with or utilize part of the door hinge to lock the door. For instance, U.S. Pat. No. 1,092,926 to Madsen describes a locking hinge having an opening in one leaf through which a portion of an upstanding lug on the other leaf protrudes when the door closes and the two hinge leaves abut so that a tapered key can be inserted in a slot in the portion of the lug protruding through the opening to prevent the door from being opened. U.S. Pat. No. 3,263,269 to McGahee describes a safety hinge having a retainer device that is attached to the door or framework in a manner that prevents the pintle from being removed from the hinge, which would allow the door to be removed. U.S. Pat. No. 3,805,325 to Lee describes a separable hinge having a hasp loop projecting from one leaf and a hasp strap secured to the pintel such that when the hasp strap is engaged over the hasp loop and a pin or the like is engaged in the hasp loop the hinge is secured in an assembled relationship. U.S. Pat. No. 6,151,757 to Beals, Jr. et al. discloses a lockable piano-type hinge assembly having a locking hinge piece, which comprises the hinge pins, with an opening that is aligned with a locking loop that extends from the hinges pieces having the pin barrels such that the locking loop protrudes through the opening so the user may attach a locking device thereto in order to prevent the hinge from opening unless the locking device is removed.

Despite the advancements offered by the prior art patents, what is needed is an improved locking door hinge apparatus that selectively prevents opening the door. The preferred locking door hinge should be configured to secure the door in closed position or, if desired in a partially open position, in a manner that prevents unauthorized opening of the door. Preferably, the locking door hinge would be relatively easy to manufacture, simple to use and adaptable to a wide variety of hinges and doors. The preferred locking door hinge should be suitable for use as one or more of the door hinges, including the upper and lower door hinges, to selectively prevent small children from being able to open the door or allow wheelchair bound persons to engage or disengage the locking mechanism. Preferably, an improved locking door hinge would allow a person to easily and quickly lock a door to prevent opening or complete opening of the door from inside a room or structure without the use of keys, latches, locks or the like.

SUMMARY OF THE INVENTION

The improved locking door hinge of the present invention solves the problems and provides the benefits identified above. That is to say, the present invention discloses an improved locking door hinge that effectively secures an exterior or interior door in manner that prevents the door from opening or, if desired, from opening all of the way. The locking door hinge of the present invention is configured substantially similar to a conventional door hinge and can be generally utilized in place of such hinges in a wide variety of different hinge and door applications. The present locking door hinge can be utilized in place of one or more standard or non-locking hinges such that the user can choose to place the improved hinge at the upper, middle and/or lower positions on the door in order to prevent small children from opening the door or to allow wheelchair bound persons to operate the locking mechanism. The locking door hinge of the present invention allows a user to choose to lock the door in the completely closed condition or to lock the door in a partially open position. The present locking door hinge is relatively simple to manufacture and easy for a person to utilize to selectively lock a door from the inside of a structure or room without the use of keys, latches, locks or the like.

In the primary embodiment of the present invention, the locking door hinge is configured for use with a door that is configured to pivot or swing relative to the door framework, such as the door jamb, to allow the user to lock the door in a closed position or a partially open position. In a preferred embodiment, the locking door hinge is configured similar to a butt hinge having a first leaf with one or more first barrels, a second leaf with one or more second barrels and a hinge pin that pivotally connects the two leaves. Each of the first and second barrels are in substantially adjacent relation with at least one of the other barrels to define a semi-continuous pintle opening through which the pintle body of the hinge pin is received. In one embodiment, the first leaf is attached to an end of the door and the second leaf is attached to the framework. The improvement comprises the addition of a locking socket that is disposed in at least the uppermost barrels of each leaf and a locking pin that is removably received in the locking socket to prevent relative rotation of the first leaf and the second leaf and, therefore, secure the door in a fixed position (i.e., closed, partially open or fully open). To lock the hinge so as to prevent movement of the door, the locking socket is in offset relation to the pintle opening. In a preferred embodiment, the locking socket is disposed in each of the plurality of barrels and the locking pin is sized to extend from the first end to substantially the second end of the locking door hinge. The locking pin has an elongated pin body and a pin head, with the locking socket being sized and configured to receive the pin body therein and the pin head being sized and/or configured to prevent full entry of the locking pin into the locking socket. In one preferred embodiment, the pin head defines a generally hook-shaped section. Also in the preferred embodiment, the locking door hinge has a plurality of locking sockets, with each being configured to receive the locking pin, so the user may select which of the locking sockets to utilize when fixing the position of the door in its closed, partially open or open position.

Accordingly, the primary objective of the present invention is to provide a locking door hinge that provides the advantages discussed above and overcomes the disadvantages and limitations associated with presently available locking door hinges and like assemblies.

It is also an object of the present invention to provide a locking door hinge that securely locks a door in the closed position or, if desired, in a partially open position.

It is also an object of the present invention to provide a locking door hinge that is configured and utilized in a manner that is similar to conventional door hinges and which can be utilized in place of such hinges.

It is also an object of the present invention to provide a locking door hinge that allows a person to easily and quickly lock a door to prevent opening or complete opening of the door from inside of a room or structure without the use of keys, latches, locks or the like.

It is also an object of the present invention to provide a locking door hinge that can be placed at the upper, middle and/or lower hinge positions on a door in order to prevent a small child from opening the door or to allow wheelchair bound persons to operate the locking mechanism.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The attached drawings are merely illustrative of a preferred embodiment and, as such, represent one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein are primarily directed to a locking door hinge utilized in place of a conventional door hinge, those skilled in the art will readily understand that this is shown merely for purposes of simplifying the present disclosure and that the present invention is not so limited.

Figure 2:
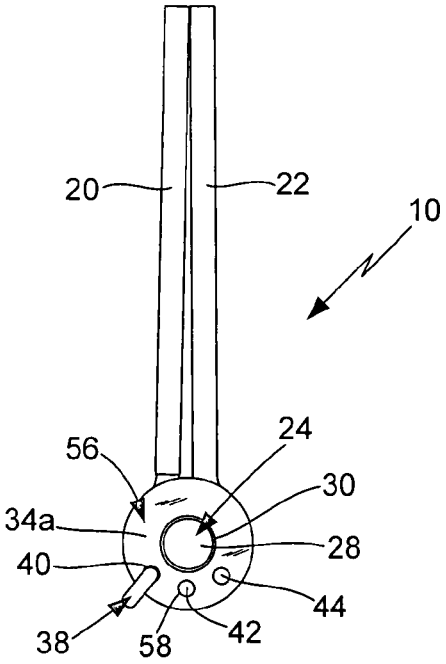
FIG. 2 is a top view of the locking door hinge of FIG. 1.
Figure 3:
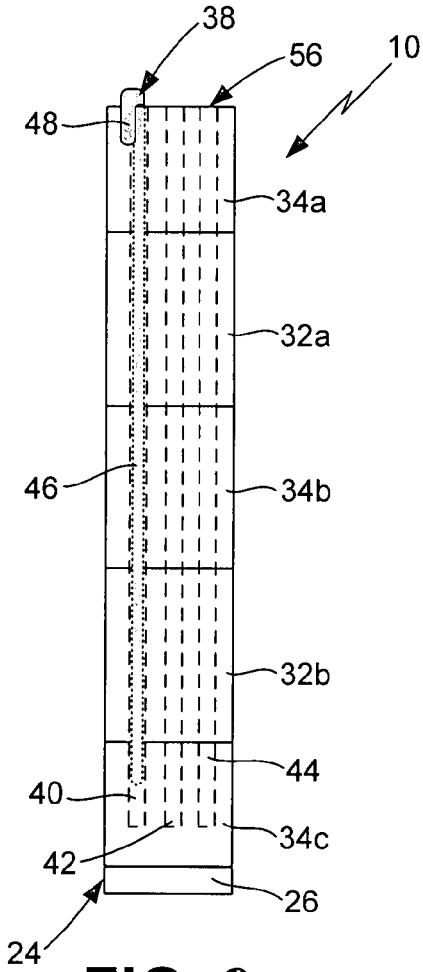
FIG. 3 is a front view of the locking door hinge of FIG. 1.
Figure 4:
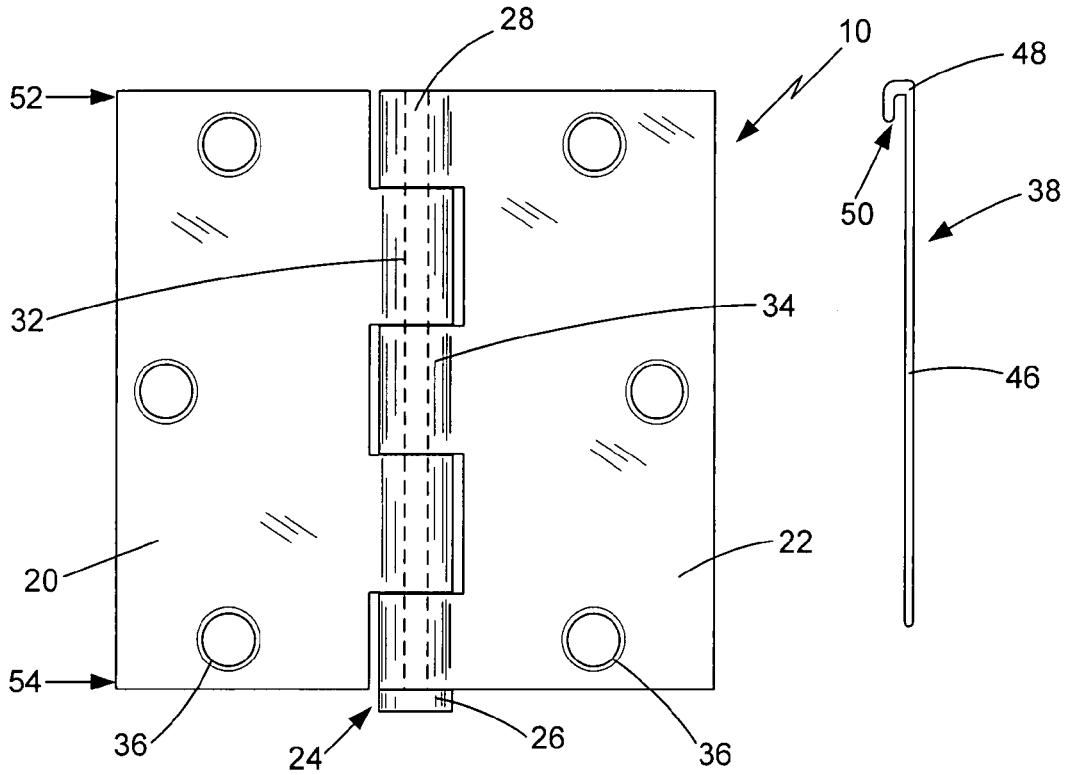
FIG. 4 is an exploded view of the locking door hinge of FIG. 3.

A locking door hinge that is manufactured out of the components of and configured pursuant to a preferred embodiment of the present invention is shown generally as 10 in the figures. Locking door hinge 10 is preferably and beneficially utilized with a door 12 to pivotally attach the door 12 to its supporting framework 14, such as a door jamb, which is typically positioned next to molding 16 along a wall 18. As with a conventional door hinge, locking door hinge 10 of the present invention is configured to allow persons to swing door 12 between its open or closed positions. The locking door hinge 10 shown in the figures is a modified version of the type of hinge known as a butt hinge, having a pair of generally rectangular leaves, such as first leaf 20 and second leaf 22, that are joined together with metal rod or hinge pin 24 (also referred to as a pintle). Hinge pin 24 has an enlarged pintle head 26 and an elongated pintle body 28, which is configured to be received in the generally centrally disposed pintle opening 30 such that pintle body 28 passes through engaged first barrels 32 and second barrels 34 at the proximal end of leaves 20 and 22, respectively, as best shown in FIGS. 2 and 4. Typically, barrels 32 and 34 are formed as an integral part of their respective leaves 20 and 22. As shown in FIG. 3, when the barrels 32 and 34 are engaged together with hinge pin 24 second barrels 34, shown as 34*a*, 34*b* and 34*c*, are separated by first barrels 32, shown as 32*a* and 32*b*. In operation, one set of the barrels 32/34 remains stationary and the other set rotates with the opening and closing of door 12. In the figures, first barrels 32*a* and 32*b* rotate relative to the stationary second barrels 34*a*, 34*b* and 34*c*. The opposite rotation is also utilized.

Figure 1:
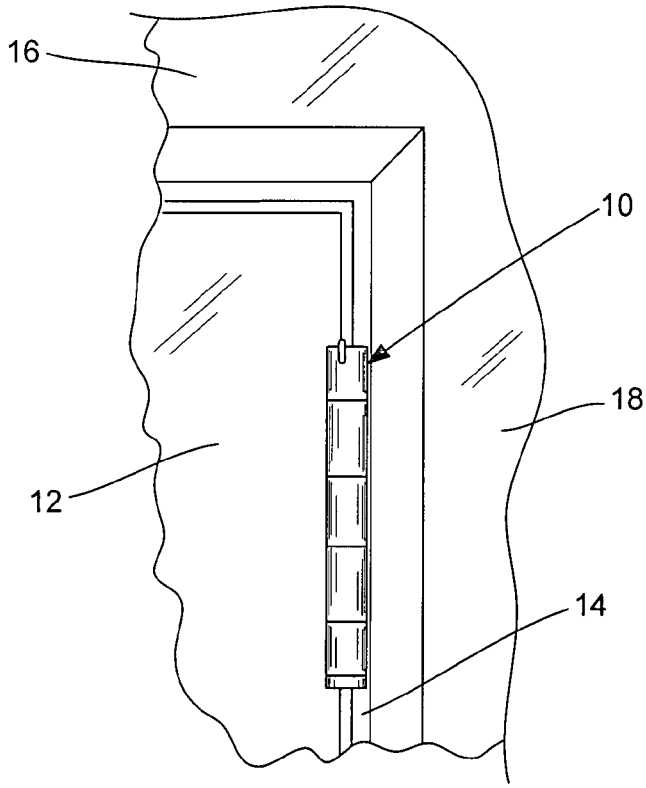
FIG. 1 is a front view of a locking door hinge configured according to a preferred embodiment of the present invention shown in use with a door supported by the framework in a closed position.

As well known in the art, one of the leaves, such as first leaf 20, attaches to one end of door 12 and the other leaf, shown as second leaf 22, attaches to the framework 14 to pivotally support door 12 so that it may swing open and close relative to framework 14 and wall 18 to allow or prevent access to the room or structure closed by door 12. As also well known, the leaves 20 and 22 typically attach to door 12 and framework 14 utilizing screws (not shown) placed through connecting apertures 36 in the leaves 20/22. Removing the hinge pintle 24 from barrels 32/34 allows the user to separate leaves 20/22 and remove door 12 from the framework 14 without having to remove the screws from door 12 and/or framework 14. As shown in FIGS. 1 and 2, when door 12 is closed the first leaf 20 and second leaf 22 meet and only the barrels 32 and 34 and the pintle head 26 are visible from inside the room or structure closed by door 12.

Figure 6:
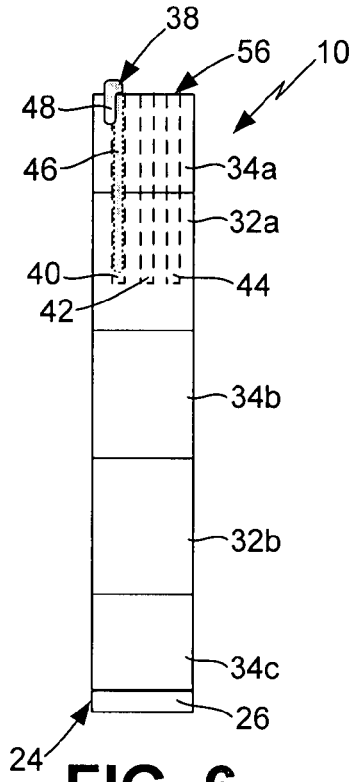
FIG. 6 is a front view of an alternative embodiment of the locking door hinge of the present invention showing the use of a locking pin and locking sockets that do not extend to the second end of the hinge.

To lock the locking door hinge 10 of the present invention, locking door hinge 10 comprises a locking pin 38 that is configured to be inserted into a locking socket, such as one of locking sockets 40, 42 and 44, disposed through barrels 32 and 34, as best shown in FIG. 3. Locking pin 38 has an elongated pin body 46 that is sized and configured to be received in locking sockets 40, 42 and 44, shown received in socket 40 in FIGS. 2 and 3, and a pin head 48 that is sized and configured to prevent full entry of locking pin 38 into locking sockets 40, 42 and 44. As shown in FIG. 4, in a preferred embodiment the pin head 48 of locking pin 38 defines a hook-shaped section 50 that is configured, as shown in FIGS. 1 through 3, to engage the first end 52 of locking door hinge 10, which in the figures is where second barrel 34*a* is positioned, when the locking pin 38 is fully received in locking socket 40 (as well as locking sockets 42 and 44). In a preferred embodiment, the pin body 46 of locking pin 48 is sized such that it will extend from the first end 52 to substantially the second end 54 of locking door hinge 10 (in the figures, the first end 52 is the upper end and second end 54 is the lower end of locking door hinge 10). As shown, it is generally not necessary to extend completely to the second end 54 to achieve the benefits of the present invention. In fact, depending on the materials and sizes utilized it may only be necessary for pin body 46 to extend through the first barrel 34*a* of second leaf 22 and partially, though generally substantially, into the adjacent first barrel 32*a* of first leaf 20, as shown in FIG. 6. As will be readily apparent to those skilled in the art, preventing rotation of any of the first barrels 32 relative to the second barrels 34 will prevent movement of first leaf 20 relative to second leaf 22 and, thereby, prevent door 12 from moving from its closed, partially closed or open position.

To achieve the locking objectives of the present invention, locking pin 38 should be configured to be sized and configured to prevent the relative pivoting of first leaf 20 and second leaf 22 by preventing the rotation of first barrels 32 and second barrels 34. As such, the pin body 46 of locking pin 38 must be of sufficient size, rigidity and strength that it will not break apart even under a relatively high load, such as may occur if someone is utilizing force against door 12, such as throwing their shoulder or kicking door 12, in an attempt to enter the room or structure closed off by door 12. The one or more locking sockets, such as sockets 40, 42 and 44 must be sized and configured to receive the sufficiently sized pin body 46 of locking pin 38. Because the size of locking sockets 40, 42 and 44 may be limited by the available space on locking door hinge 10, it may be preferred to utilize a relatively high strength material for locking pin 38. For ease of use, it is preferred that pin head 48 of locking pin 38 be configured such that the user can easily place locking pin 38 in one of the locking sockets 40, 42 or 44 to lock door 12 and remove it therefrom when it locking is no longer necessary. Although a hook-shaped section 50 is shown, various other sizes and/or configurations, including an enlarged globe or other shapes for pin head 48, can be utilized with locking pin 38 to allow the user to easily lock or unlock door 12 with locking door hinge 10. One advantage of the hook-shaped section 50 is that locking pin 38 can be "stored" with the small downward projection in one of the locking sockets 40/42/44 when not being utilized to lock door 12.

Figure 5:
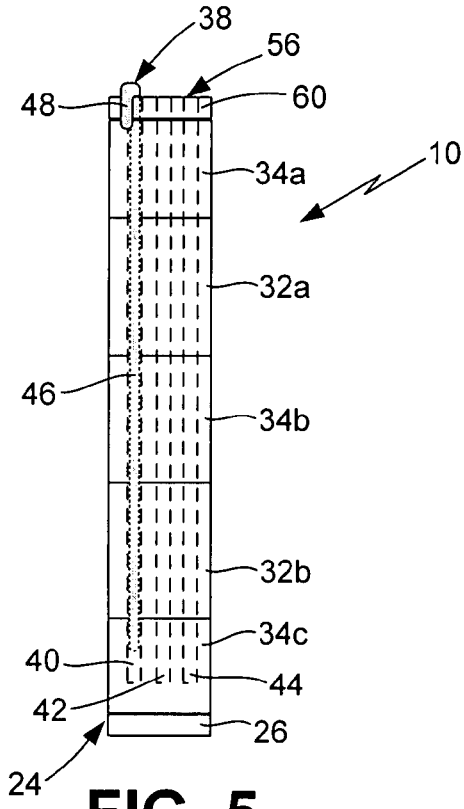
FIG. 5 is a front view of an alternative embodiment of the locking door hinge of the present invention showing the use of an end cap at the first end of the door hinge.

As best shown in FIG. 2, the locking door hinge 10 of the present invention has an end surface 56 at first end 52 that comprises a socket aperture 58 for each of the locking sockets 40, 42 and 44. In the embodiment shown in FIGS. 1 through 4, end surface 56 is defined by the surface of the uppermost second barrel, shown as 34*a*. In an alternate configuration, end surface 56 can be defined by the uppermost first barrel 32*a* if it is positioned at first end 52. In the alternative configuration of FIG. 5, in which locking door hinge 10 has an end cap 60 at the first end 52 thereof, the end surface 56 is defined by the upper surface of end cap 60. Each of the socket apertures 58 is in continuity with one of the locking sockets 40, 42 and 44. As shown in FIG. 3, it is generally preferred that the locking sockets 40, 42 and 44 extend in the barrels 32 and 34 generally to the second end 54 of locking door socket 10 in order to be able to receive a locking pin 38 having a sufficiently long pin body 46 to fully prevent unauthorized opening of door 12, even when force is utilized, when locking door hinge 10 is engaged. In the alternative embodiment shown in FIG. 6, locking sockets 40, 42 and 44 only extend part of the way towards second end 54. In either of these embodiments, locking socket 40, 42 and 44 can extend all the way to the bottom of the lowermost barrel (i.e., 34*c* in FIG. 3 or 32*a* in FIG. 6) in which it is placed or extend only partially to the bottom of such barrels. Although having the socket 40, 42 or 44 and locking pin 38 only partially extending into the bottom barrel will achieve the desired locking action, it is generally preferred to extend closer to the bottom of such barrels for increased locking strength.

To lock the relative movement of first leaf 20 to second leaf 22 so as to prevent movement of door 12, it is necessary that the locking sockets 40, 42 and 44 be offset relative to the pintle opening 30 through which the pintle body 28 of hinge pin 24 is received. The offset positioning of sockets 40, 42 and 44 prevents the first barrels 32 and the second barrels 34 from rotating around hinge pin 24 and, therefore, prevents the door 12 from moving (i.e., from opening if door 12 is in a closed position). In one embodiment, locking door hinge 10 is provided with a single locking socket (such as locking socket 40) that receives locking pin 38. To allow the user to better be able to selectively choose where he or she desires to lock the position of door 12, however, the preferred configuration of the locking door hinge 12 of the present invention has a plurality of locking sockets, shown as 40, 42 and 44. The various locking sockets 40, 42 and 44, each of which is sized and configured to receive locking pin 38 therein, allows the user to choose to lock the door 12 in its closed position or in a partially open position. While the fully closed position for door 12 provides the most security, the partially opened positions allows the user to be able to "crack" the door 12 open to receive fresh air into the room or structure or be partially open to allow the family pet to go in and out of the room or structure while still providing security with regard to preventing the door from fully opening. If desired, a locking socket can also be provided to allow the user to utilize locking door hinge 10 of the present invention to secure door 12 in its fully open position so that air or persons may pass through without worry that the wind or other force will slam door 12 shut.

In a preferred embodiment, the interior surface of the various locking sockets 40, 42 and 44 and the exterior surface of locking pin 38 are smooth so the locking pin 38 will easily and with no manipulation slide in and out of locking sockets 40, 42 and 44. In an alternative embodiment, the locking pin 38 and locking sockets 40, 42 and 44 can be cooperatively configured such that the locking pin 38 does not just slide out of the locking sockets 40, 42 and 44. If desired, the locking pin 38 and sockets 40/42/44 can be configured with a twist and engage arrangement or a mechanical locking device to secure the locking pin 38 in one of the locking sockets 40/42/44. Providing locking door hinge 10 with a locking pin 38 that can be secured in locking sockets 40/42/44 may be beneficial for circumstances where the locking door hinge 10 is not always in an upright position or where it is desirable to keep certain persons, such as small children or the mentally disabled, from being able to remove locking pin 38 from the locking socket 40/42/44 in which it is placed.

The materials for the leaves 20/22 and hinge pin 24 components of locking door hinge 10 can be those which are commonly utilized for door hinges, including various metals such as steel, brass and the like. As stated above, the material for locking pin 38 should be chosen to provide the desired door locking strength, which may be at least partially based on the length of pin body 46. In use, the user will install locking door hinge 10 in place of where standard door hinges are utilized. For instance, the typical interior or exterior door for homes and businesses have a hinge located near the top, middle and bottom of the door. As with standard hinges, locking door hinge 12 is attached utilizing screws or other connectors through the connecting apertures 36 to attach one leaf, such as first leaf 20, to the end of door 12 and the other leaf, such as second leaf 22, to the door framework 14. Once installed, the non-locking use of locking door hinge 10 will be the same as for the standard hinge in that door 12 will swing open or closed as desired by the user and those who pass into the room or structure. To secure the door 12 in a fixed position, whether closed, partially open or completely open, the user merely inserts locking pin 38 into one of the locking sockets 40, 42 or 44, as desired. With the locking pin 38 in place, the first barrels 32 and second barrels 34 will not be able to rotate relative to each other, thereby preventing the first leaf 20 and second leaf 22 from pivoting and the door 12 from moving. With locking door hinge 10 used in place of each of the standard hinges on door 12, the user can select in which locking door hinge 10 (i.e., the top, middle or bottom position) he or she desires to place locking pin 38 to lock door 12 in place. In this manner, the door 12 can be locked so as to prevent a young child from unlocking the door 12 (i.e., the top position) or to allow a handicapped person to lock and unlock the door 12 (i.e., the bottom position). If desired, the user can lock more than one of the locking door hinges 10 utilized with door 12. When the user desires to unlock the door 12 to allow movement thereof, all he or she needs to do is to remove the locking pin 38 from the locking aperture 40/42/44 in which it was placed.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A locking door hinge for preventing movement of a door, said locking door hinge comprising:

a first leaf having one or more first barrels;

a second leaf having one or more second barrels, each of said second barrels in substantially adjacent relation with at least one of said first barrels;

a hinge pin having a pintle body disposed in a pintle opening through said first barrels and said second barrels to pivotally interconnect said first leaf and said second leaf;

at least one locking socket disposed in at least one of said first barrels and at least one of said second barrels, each of said locking sockets in offset relation to said pintle opening; and a locking pin removably received in one of said locking sockets so as to prevent relative rotation of said first leaf and said second leaf, wherein a first end of said locking door hinge has an end cap defining an end surface, said end surface having a socket aperture in continuity with said at least one locking socket.

2. The locking door hinge according to claim 1, wherein said first leaf is configured to be attached to said door, said second leaf is configured to be attached to a framework for said door and said locking pin prevents rotation of said first leaf relative to said second leaf.

3. The locking door hinge according to claim 1, wherein said at least one locking socket is disposed in each of said first barrels and each of said second barrels so as to receive said locking pin from said first end of said locking door hinge to substantially a second end of said locking door hinge.

4. The locking door hinge according to claim 1, wherein said first leaf has a plurality of first barrels, said second leaf has a plurality of second barrels and said at least one locking socket is disposed in each of said first barrels and each of said second barrels.

5. The locking door hinge according to claim 1, wherein said locking pin has an elongated pin body and a pin head, said at least one locking socket sized and configured to receive said pin body, said pin head sized and/or configured to prevent full entry of said locking pin into said at least one locking socket.

6. The locking door hinge according to claim 5, wherein said pin head of said locking pin comprises a hook-shaped section.

7. The locking door hinge according to claim 1, wherein said locking door hinge comprises a plurality of locking sockets, each of said plurality of locking sockets configured to receive said locking pin so as to prevent relative rotation of said first leaf and said second leaf thereof.

8. A locking door hinge for preventing movement of a door, said locking door hinge comprising:

a first leaf having a plurality of first barrels;

a second leaf having a plurality of second barrels, each of said second barrels in substantially adjacent relation with at least one of said first barrels;

a hinge pin having a pintle body disposed in a pintle opening through said first barrels and said second barrels to pivotally interconnect said first leaf and said second leaf;

at least one locking socket disposed in at least one of said first barrels and at least one of said second barrels, each of said locking sockets in offset relation to said pintle opening; and a locking pin having an elongated pin body and a pin head, said pin body removably received in one of said locking sockets so as to prevent relative rotation of said first leaf and said second leaf, said pin head sized and/or configured to prevent full entry of said locking pin into said locking socket, wherein a first end of said locking door hinge has an end cap defining an end surface, said end surface having a socket aperture in continuity with said at least one locking socket.

9. The locking door hinge according to claim 8, wherein said first leaf is configured to be attached to said door, said second leaf is configured to be attached to a framework for said door and said locking pin prevents rotation of said first leaf relative to said second leaf.

10. The locking door hinge according to claim 8, wherein said locking socket is disposed in each of said first barrels and each of said second barrels so as to receive said locking pin from said first end of said locking door hinge to substantially a second end of said locking door hinge.

11. The locking door hinge according to claim 8, wherein said pin head of said locking pin comprises a hook-shaped section.

12. The locking door hinge according to claim 8, wherein said locking door hinge comprises a plurality of locking sockets, each of said plurality of locking sockets configured to receive said locking pin so as to prevent relative rotation of said first leaf and said second leaf thereof.

13. A locking door hinge for preventing movement of a door, said locking door hinge comprising:

a first leaf configured to be attached to said door, said first leaf having a plurality of first barrels;

a second leaf configured to be attached to a framework for said door, said second leaf having a plurality of second barrels, each of said second barrels in substantially adjacent relation with at least one of said first barrels;

a hinge pin having a pintle body disposed in a pintle opening through said first barrels and said second barrels to pivotally interconnect said first leaf and said second leaf;

at least one locking socket disposed in each of said first barrels and each of said second barrels, each of said locking sockets in offset relation to said pintle opening; and a locking pin having an elongated pin body and a pin head, said pin body removably received in one of said locking sockets so as to prevent relative rotation of said first leaf and said second leaf, said pin head sized and/or configured to prevent full entry of said locking pin into said locking socket, wherein a first end of said locking door hinge has an end cap defining an end surface, said end surface having a socket aperture in continuity with said at least one locking socket.

14. The locking door hinge according to claim 13, wherein said pin head of said locking pin comprises a hook-shaped section.

15. The locking door hinge according to claim 13, wherein said locking door hinge comprises a plurality of locking sockets, each of said plurality of locking sockets configured to receive said locking pin so as to prevent relative rotation of said first leaf and said second leaf thereof.

* * * * *